United States Patent [19]

Riddle

[11] Patent Number: 4,985,095

[45] Date of Patent: Jan. 15, 1991

[54] PREFORMED STAIR RISER TILE PRODUCT

[75] Inventor: Dennis L. Riddle, LaGrange, Ga.

[73] Assignee: Milliken Research Corporation, Spartanburg, S.C.

[21] Appl. No.: 263,808

[22] Filed: Oct. 28, 1988

[51] Int. Cl.[5] ..... B31F 1/00; E04F 11/00

[52] U.S. Cl. ..... 156/064; 156/71; 156/211; 156/214; 156/257; 16/11; 428/88; 52/179; 52/188

[58] Field of Search ..... 16/10, 11; 428/88; 156/211, 214, 257, 71; 52/179–181, 188, 189

[56] References Cited

U.S. PATENT DOCUMENTS

| | | | |
|---|---|---|---|
| 2,288,470 | 6/1942 | Lorraine | 52/179 |
| 3,456,701 | 7/1969 | Cornell | 156/211 |
| 3,895,981 | 7/1975 | Tesch | 16/10 |

FOREIGN PATENT DOCUMENTS

| | | | |
|---|---|---|---|
| 2418722 | 4/1975 | Fed. Rep. of Germany | 52/179 |
| 3511912 | 10/1986 | Fed. Rep. of Germany | 52/179 |

*Primary Examiner*—Kurt Rowan
*Assistant Examiner*—Edward A. Brown
*Attorney, Agent, or Firm*—Earle R. Marden; H. William Petry

[57] ABSTRACT

A method to form a carpet tile into a configuration for use on a stair riser. This method involves measuring the stair riser and using this measurement to score the pile on the face of a tile. The tile is then bent to a 90° angle and a nose guard adhesively placed over the bent or nose portion of the tile to provide a preformed product. This product then can be taken on the job, placed into position and readily tacked or glued down to provide the stairs with a tile product which is comparable to the adjacent tiled areas.

2 Claims, 1 Drawing Sheet

PREFORMED STAIR RISER TILE PRODUCT

This invention relates generally to carpet tiles and in particular to the formation of preformed carpet tiles for stair risers that can have a pattern that matches the carpet at the base or at the top of the stair risers.

In the past the users of modular carpet products have had a problem as to what type of carpet to use in the stair areas. This problem occurs especially in the use of patterned carpet tiles because traditionally carpet tiles have not been used on stairs and the broadloom carpet used did not match the pattern on the carpet tile creating a mismatch or at least an inconsistent aesthetic effect between the floor area and the stair area. At times it has been proposed to use the same carpet tiles on the stairs that was used on the broad flat surfaces and cut and install them on the stairs. This is impractical, very labor intensive and expensive.

Therefore, it is an object of the invention to provide a preformed carpet tile product for use on stair risers which will match the other carpet areas and can be readily installed with a minimum expense of labor.

Other objects and advantages of the invention will become readily apparent as the specification proceeds to describe the invention with reference to the accompanying drawings, in which.

Figure 1:
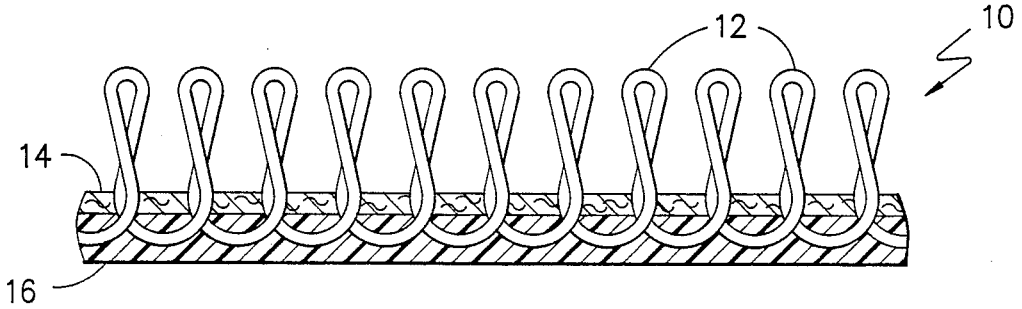
FIG. 1 represents a standard carpet tile product.
Figure 2:
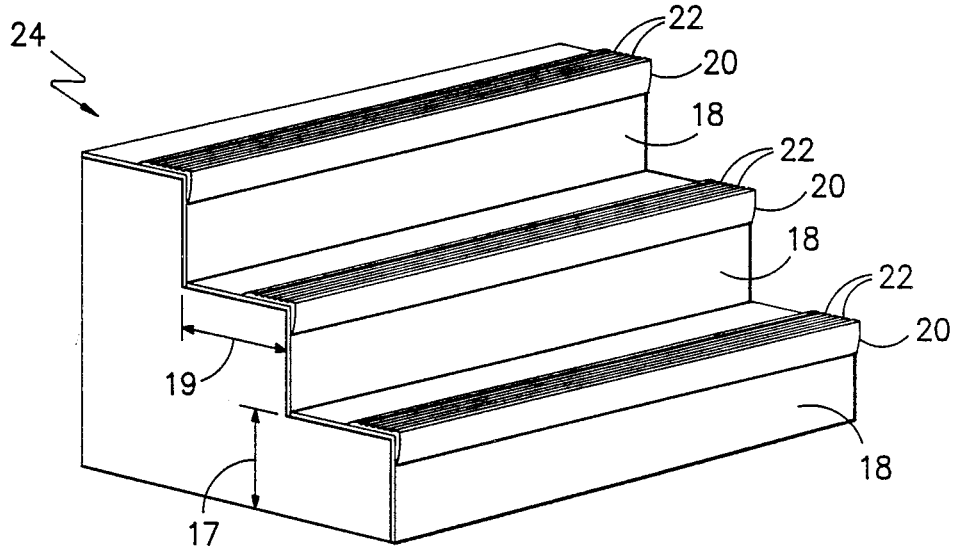
FIG. 2 represents the product of FIG. 2 installed on a stair riser.
Figure 3:
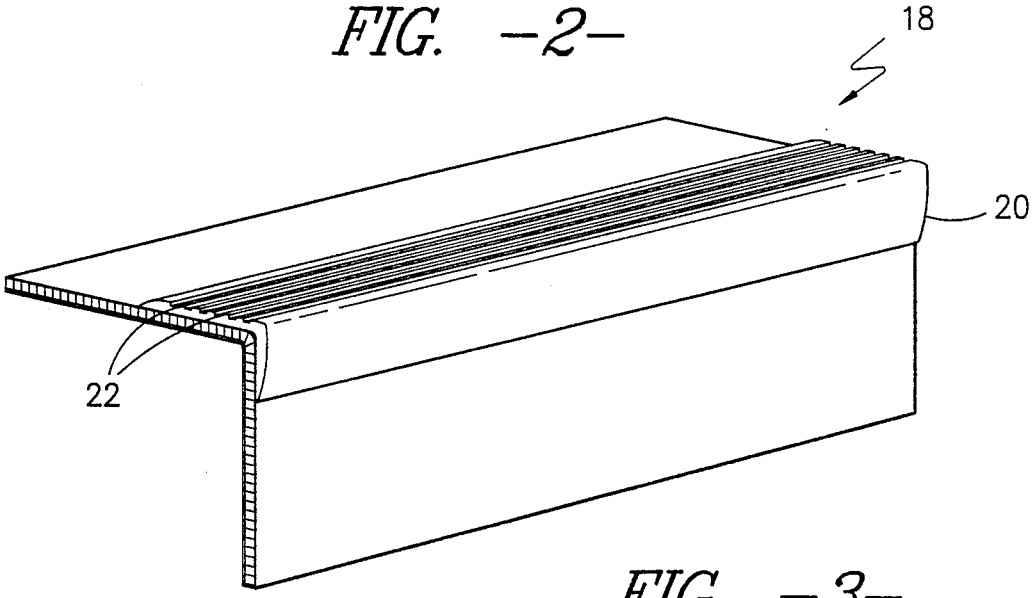
FIG. 3 illustrates a preformed carpet tile ready for installation.

A typical carpet tile 10 is shown in FIG. 1 and basically consists of a plurality of yarns 12, preferably polyester or nylon, tufted into the backing 14 of woven polyester and secured into position by a suitable backing material 16 of PVC, atactic polypropylene, etc. Conventionally the carpet tile 10 is made in 18′ squares for installation in a modular carpet design area.

Traditionally, the ideal stair riser 17 is 7½ inches, while the step 19 is 10 inches, which dimensions would not fit in with the conventional 18′ square carpet tile size. These two dimensions can be adjusted in the formation of the preformed stair riser carpet tile product 18.

Initially, the customer informs the manufacturer the dimensions of the stair risers on a particular job. Then the carpet tile 10, having the desired pattern thereon, is selected and riser dimension marked on the face thereof. Then the tile 10 is scored on the face side thereof with a suitable cutting tool, along the marked portion of the tile. Then the tile is bent at a 90° angle along the score line to bring the backing material 16 of one portion of the tile towards the backing material of the other portion of the tile. Then a commercially available plastic-like nose guard 20 is placed over the score line of the bent tile 18 and adhered to with a suitable adhesive, such as an all purpose commercially available hot melt adhesive. Upon cooling of the adhesive the carpet tile 10 remains in the preformed stair riser tile shape 18 and is ready for installation at the desired location.

As indicated above, the preformed stair riser tile riser product 18 can be made in various dimensions with multiple widths being used and cut to size for various length steps. The longer preformed members can be made at the plant with a continuous nose guard and cut to length upon installation.

The drawings show a loop pile carpet product but obviously cut pile carpet tiles could be used just as well. Preferably the nose guard selected will tread stripes 22 thereon to provide better traction for people walking up and down the stairs 24.

Although the preferred embodiment of the invention has been described, it is contemplated that changes may be made without departing from the scope or spirit of the invention and it is, therefore, desired that the invention be limited only by the scope of the claims.

I claim:

1. A method to form a stair riser carpet tile product comprising the steps of: selecting a carpet tile having a pile face and fairly stiff backing, measuring the height of a stair riser on the face of the carpet tile, scoring the face of the carpet tile across the width thereof along the measured dimension, bending the carpet tile at an angle of substantially 90° in a direction away from the face of the carpet pile and adhering a nose guard to the carpet tile along the whole length of the score line.

2. The method of claim 1 wherein the nose guard is secured by a hot melt adhesive and the tile is allowed to cool after the adherence of the nose guard.

* * * * *